US005845476A

United States Patent [19]

Kolmes

[11] Patent Number: 5,845,476

[45] Date of Patent: Dec. 8, 1998

[54] COMPOSITE YARN WITH FIBERGLASS CORE

[76] Inventor: Nathaniel H. Kolmes, 1740 5th St. Dr. NW., Hickory, N.C. 28601

[21] Appl. No.: 868,564

[22] Filed: Jun. 4, 1997

[51] Int. Cl.[6] ..... D02G 3/02

[52] U.S. Cl. ..... 57/229; 57/210; 57/230; 57/231

[58] Field of Search ..... 57/210, 229, 230, 57/231

[56] References Cited

U.S. PATENT DOCUMENTS

| | | | |
|---|---|---|---|
| 2,335,644 | 11/1943 | Camp | 139/383 |
| 4,202,382 | 5/1980 | Westhead | 1396/383 |
| 4,777,789 | 10/1988 | Kolmes | 57/210 |
| 4,838,017 | 6/1989 | Kolmes | 57/210 |
| 4,912,781 | 4/1990 | Robins et al. | 57/210 |
| 4,936,085 | 6/1990 | Kolmes et al. | 57/229 |
| 5,070,540 | 12/1991 | Bettcher et al. | 57/229 |
| 5,119,512 | 6/1992 | Dunbar et al. | 2/167 |
| 5,177,948 | 1/1993 | Kolmes et al. | 57/229 |
| 5,287,690 | 2/1994 | Toon | 57/210 |
| 5,423,168 | 6/1995 | Kolmes et al. | 57/229 |
| 5,628,172 | 5/1997 | Kolmes et al. | 57/210 |
| 5,632,137 | 5/1997 | Kolmes et al. | 57/212 |
| 5,655,358 | 8/1997 | Kolmes | 57/212 |

FOREIGN PATENT DOCUMENTS

| | | | |
|---|---|---|---|
| 498216 | 8/1992 | European Pat. Off. | 57/229 |

OTHER PUBLICATIONS

World Fibers Yarn Product Style No. WF–331 (sketch); date unknown.

*Primary Examiner*—William Stryjewski
*Attorney, Agent, or Firm*—Rhodes, Coats & Bennett, L.L.P.

[57] ABSTRACT

The present invention relates to a yarn core construction suitable for forming a flexible composite yarn having a fiberglass component. The resulting yarn has good cut and abrasion resistance qualities without sacrificing knittability, flexibility and suppleness. A normally hard to knit fiberglass strand is wrapped with a sheath strand at a rate of at least 8 turns per inch. The core thus formed provides all of the benefits of a fiberglass supported yarn without experiencing any of the manufacturing difficulties normally associated with fiberglass yarns. The core may also be provided with a multi-layer covering to balance the yarn and to further improve knittability.

27 Claims, 1 Drawing Sheet

COMPOSITE YARN WITH FIBERGLASS CORE

BACKGROUND OF THE INVENTION

The present invention relates generally to yarns, fabrics and protective garments knitted of such yarns. More particularly, the present invention relates to a yarn core construction which provides improved comfort, flexibility and pliability in both protective garments such as a gloves and also a variety of other applications.

In many industries, it is desirable to provide protective garments, particularly gloves, to protect employees from being cut. Ideally, such garments should be flexible, pliable, soft and cut resistant. Typically, any improvement in the last of these characteristics has usually been at the sacrifice of the others. Protective garments have been made cut resistant in the past through the use of yarns which contain wire. However, the use of wire is problematic in environments where a protective garment must not be electrically or thermally conductive. Moreover, experience has shown that the wire may break and injure the hand of the wearer. Lastly, articles or garments having a high wire content may be difficult and/or expensive to clean using conventional cleaning techniques.

In response to these problems, non-metallic cut-resistant yarns have been developed. These yarns have been described in U.S. Pat. No. 5,177,948 to Kolmes et al. which is owned by the assignee of the present invention. The contents of that patent are incorporated herein by reference. Kolmes describes a yarn having substantially parallel core strands which may include fiberglass. Kolmes does not describe wrapping an untwisted fiberglass yarn with a sheath yarn so as to change the knitting characteristics of the fiberglass yarn. Subjecting a fiberglass yarn strand to severe twisting degrades its performance and impedes its knittability. It is believed that some of the individual filaments of a multi-filament fiberglass yarn strand are not picked up cleanly by the needles of a conventional knitting machine. Thus the strands, given their inherent brittleness, break easily during knitting. These problems have prevented use of the yarns described in Kolmes extensively outside of traditional cut/abrasion resistant applications because they have not had desirable characteristics for uses such as fashion apparel.

There remains a need for a cut-resistant yarn core construction having a fiberglass component, which, when incorporated with other yarns into a composite yarn, is suitable for knitting into a fabric, protective garment or other article having improved flexibility and softness.

SUMMARY OF THE INVENTION

The present invention relates to a composite core yarn construction formed of a substantially untwisted fiberglass strand wrapped with another yarn. This construction renders the normally difficult to knit fiberglass much more supple and flexible thus improving its manufacturing qualities. The yarn offers increased strength in a finer denier. Articles manufactured from the yarn can be expected to be more comfortable without the drawbacks seen in previous cut/abrasion resistant articles.

The present invention includes a flexible, composite, cut and abrasion resistant yarn comprised of a substantially untwisted fiberglass strand having a denier of between about 100 and about 1200 and a sheath strand having a denier of between about 200 and about 700. The cover strand is wrapped around the fiberglass core strand at the rate of at least 8 turns per inch. The yarn could further comprise a non-metallic covering including a bottom cover strand wrapped about the yarn in a direction opposite to that of the sheath strand; and a top cover strand wrapped about said bottom cover strand in a direction opposite to that of the bottom cover strand.

The yarn desirably has a composite denier of from about 1800 to about 5000.

Another embodiment of the present invention could include two fiberglass strands in the core construction. Here the non-metallic composite core would include a first fiberglass strand and a second fiberglass strand, the second fiberglass strand being substantially parallel to and in an untwisted relationship with the first fiberglass strand. In this embodiment the first and second fiberglass strands have a combined denier of about between about 200 and about 600. This core construction of this embodiment further includes a sheath strand having a denier of between about 200 to about 600, the sheath strand being wrapped around the first and second fiberglass strands at the rate of at least 8 turns per inch. This embodiment also includes a non-metallic covering wrapped on the core. The covering includes a bottom cover strand wrapped about the core in a direction opposite to that of the sheath strand, the bottom cover having a denier of about 650 and being formed of fibers or filaments of extended chain polyethylene. The covering also includes a top cover strand wrapped about the bottom cover strand in a direction opposite to that of the bottom cover strand, the top cover strand having a denier of about 400 and being formed from fibers or filaments of nylon. This embodiment has a composite denier of between about 1800 and about 5000.

Therefore one aspect of the present invention is to provide a core yarn construction for a cut/abrasion resistant composite yarn featuring a knittable covered fiberglass strand.

Another aspect of the present invention is a core yarn construction which provides strength characteristics of prior art yarns in a finer denier.

BRIEF DESCRIPTION OF THE DRAWINGS

The various benefits and advantages of the present invention will be more apparent upon reading the following detailed description of the invention taken in conjunction with the drawings.

In the drawings, wherein like reference numbers identify a corresponding component.

DETAILED DESCRIPTION OF THE PREFERRED EMBODIMENTS

Figure 1:
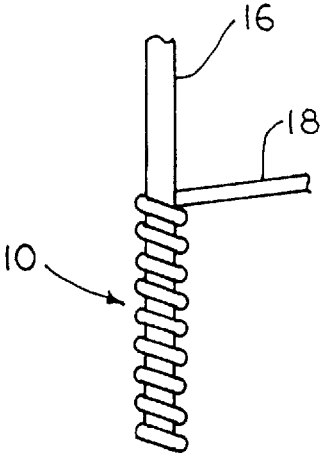
FIG. 1 illustrates the core yarn construction in accordance with the principles of the present invention.

Turning to FIG. 1, the yarn core construction of the present invention is referred to generally at 10. The non-metallic core includes a single substantially untwisted fiberglass strand 16 and a sheath strand 18. The sheath strand is wrapped around the fiberglass strand at a rate of at least 8 turns per inch. As used herein the term cover does not require that the sheath strand completely cover or coat the single fiberglass strand. Rather the cover strand must have a sufficient number of turns per inch to give a substantially untwisted fiberglass core strand the properties discussed herein below.

Figure 2:
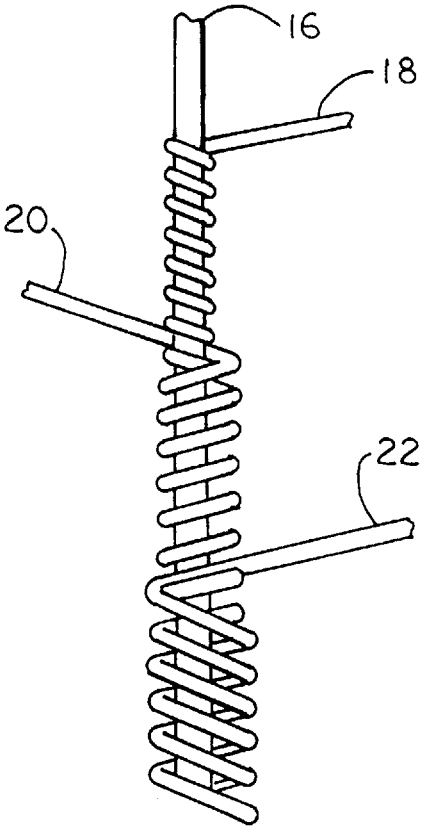
FIG. 2 illustrates the yarn depicted in FIG. 1 with the addition of two covering strands.

At this point the core yarn may be knit for a variety of new uses as is described in more detail herein below. However, to improve its manufacturing qualities, the yarn may further include a non-metallic covering wrapped on the core yarn as shown in FIG. 2. There the core yarn construction described above includes a covering including a bottom cover strand 20 wrapped about the core in a first direction which may be opposite to that of the sheath strand. A top cover strand 22 may be provided wrapped about the bottom cover strand in a second direction opposite to that of the bottom cover to complete the yarn of the present invention. Each of the strands used in the present invention is non-metallic.

The fiberglass strand (or strands) in the core may be either E-glass or S-glass of either continuous filament or spun. The practice of the present invention contemplates using several different sizes of commonly available fiberglass strand, as illustrated in Table 1 below:

TABLE 1

| Fiberglass Size | Approximate Denier |
|---|---|
| G-450 | 99.21 |
| D-225 | 198.0 |
| G-150 | 297.6 |
| G-75 | 595.27 |
| G-50 | 892.90 |
| G-37 | 1206.62 |

The size designations in the Table are well known in the art to specify fiberglass strands.

Figure 3:
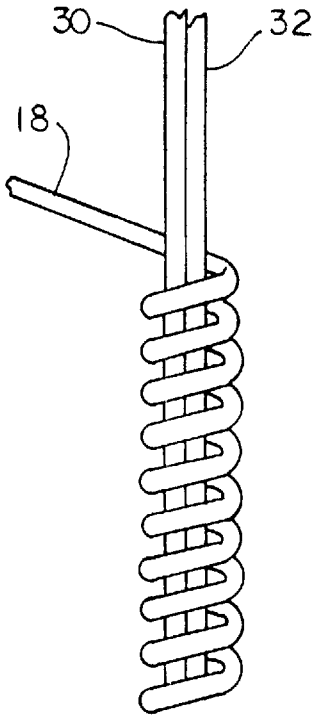
FIG. 3 is an illustration of an alternative embodiment having a two fiberglass strand core.

These fiberglass strands may be used singly or in combination depending on the particular application for the finished article. By way of non-limiting example, if a total denier of about 200 is desired for the fiberglass component of the core, either a single D-225 or two substantially parallel G-450 strands may be used. The two G-450 strands preferably are in an untwisted relationship with each other. This embodiment is illustrated in FIG. 3 where the core construction is composed of a first fiberglass strand 30 and a second fiberglass strand 32 which is substantially parallel to and in an untwisted relationship with the first fiberglass strand. In a preferred embodiment these strands will have a combined denier of about between 200 and about 600. The yarn further includes a sheath strand 18 having a denier between about 200 and about 600. The sheath strand is wrapped about the fiberglass strands at a rate of at least 8 turns per inch and preferably about 12 to 14 turns per inch.

This dual fiberglass strand core embodiment may further include a non-metallic covering as described above. In a preferred embodiment the bottom cover may have a denier of about 650 and be formed of fibers or filaments of extended chain polyethylene.

The top cover strand may have a denier of about 400 and may be formed from fibers or filaments of nylon. In this embodiment the yarn has a composite denier of between about 1800 and about 5000.

It should be understood that the table above illustrates currently available fiberglass strand sizes. The practice of the present invention contemplates the use of other fiberglass strand sizes as they become available in the market or as found to be suitable for particular applications.

Suitable types of fiberglass fiber are manufactured by Corning and by PPG. The fibers have the desirable properties of relatively high tenacity, of about 12 to about 20 grams per denier, resistance to most acids and alkalis, being unaffected by bleaches and solvents, resistance to environmental conditions such as mildew and sunlight, and high resistance to abrasion and to aging.

The sheath strand may have a denier of from about 200 to about 400 and may be formed of fibers or filaments selected from the group consisting of high performance yarns such as extended chain polyethylene or aramid, or from more conventional yarns such as nylon and polyester. Desirably the sheath strand is formed from a textured yarn particularly when it is formed from nylon. In a preferred embodiment the sheath strand has a denier of about 375. Desirably, the single fiberglass strand has a denier of about 200.

The selection of the sheath strand will depend in part on the desired properties and end use of the finished yarn. For example, an extended chain polyethylene such as that sold under the SPECTRA® brand may be used for its durability and abrasion resistance. Other suitable materials include aramid such as Dupont's KELVAR® fiber, a polyethylene fiber such as CERTRAN® fiber manufactured by Hoechst Celanese. The CERTRAN® fiber is believed to provide performance similar to the SPECTRA® fiber at a lower cost. Another Hoechst product, VECTRAN® fiber, is suitable where high heat resistance is important for the finished article. This fiber is a polyester based liquid crystal fiber which is also desirable for use in cut-resistant articles. Again, the selection of a particular fiber will depend on cost considerations and the end use of the article constructed from the yarn.

The selection of the sheath strand may also depend on the denier of the first core strand. The finer the denier used in the first core strand the finer the sheath strand. The size of the sheath strand increases with the size of the first core strand.

The bottom cover 20 is wrapped about the core in a direction opposite to that of the sheath strand, and, in a preferred embodiment, is formed of extended chain polyethylene. The bottom cover may have a denier of about 500 to about 800 and desirably about 650. The bottom cover 20 is wrapped about the core at a rate of about 7 to 10 turns per inch, and preferably about 8 to 9 turns per inch. The number of turns per inch for the bottom core decreases as heavier strands are used in the core. Other suitable materials for the bottom cover include aramid, polyester, and nylon.

The top cover 22 is wrapped about the bottom cover in a direction opposite to that of the bottom cover and has a denier of from about 400 to about 800, and preferably of about 500. The top cover may be wrapped about the core and the bottom cover at a rate of about 8 to about 11 turns per inch, preferably at a rate of about 9 to about 10 turns per inch.

Desirably, top cover 22 is formed from nylon. Other suitable materials for the top cover include extended chain polyethylene, aramid, and polyester.

The use of a top cover will be determined by the need to provide better coverage for the core, to balance the overall yarn construction, or to make the yarn more knittable. The end use of a article constructed from the yarn may determine the need and material selection for the top cover. For instance, if the yarn will be knit into a fabric which will be dyed, polyester or nylon may be used for the top cover to take advantage of the relative ease with which they may be dyed.

In a preferred embodiment the overall denier of the yarn of the present invention to include the fiberglass strand, the sheath strand, the bottom cover, and the top cover is from about 1800 denier to about 5000 denier.

By way of non-limiting example, yarn constructions utilizing the principles of the present invention are illustrated as Examples 1 and 2 in Table 2 below:

TABLE 2

| | Example 1 | Example 2 |
|---|---|---|
| Core Fiberglass | G-75 | G-150 |
| Sheath | 650 Spectra ® Fiber | 375 Spectra ® Fiber |
| Bottom Cover | 650 Spectra ® Fiber | 650 Spectra ® Fiber |
| Top Cover | 1000 polyester | 500 polyester |

The Example 2 yarn would be knit using a 10 gauge knitting machine while the Example 1 yarn would be knit using a 7 gauge knitting machine.

The yarn of the present invention may be manufactured on standard knitting equipment. If the yarn will be provided with the cover layers, preferably the untwisted fiberglass strand is wrapped with the cover strand in a first step. Next, the bottom and top cover strands are added in a second operation on a separate machine.

The yarn of the present invention has several advantages over the non-metallic cut resistant yarns described herein above. Understanding these advantages requires a discussion of the properties of fiberglass strand material and its use in making yarns. Fiberglass has excellent tensile strength properties that make it attractive for use in a cut or abrasion resistant article. However, fiberglass is also quite brittle making it difficult to knit fiberglass fibers on conventional knitting equipment. Fiberglass strands cannot make the required sharp turns around knitting machine components without breaking. This breakage can cause the fiberglass component of a yarn to wash out presenting a fuzzy or "hairy" appearance.

The brittle nature of fiberglass also prevents it from being formed into a twisted composite yarn structure. The process of twisting the fiberglass with another yarn causes the fiberglass to make sharp turns and thus develop fracture points along the fiberglass strand leading to the problems described above. It should be understood that the fiberglass strands contemplated for use in the present invention typically are composed of a number of filaments held together by some amount of twist. However, the detrimental twisting discussed here refers to combining two or more parallel singles yarns into a multiple strand yarn.

It has been discovered that wrapping a cover strand around a fiberglass strand permits the fiberglass strand to make the sharp turns required in a knitted article without breaking. It is believed that the sheath yarn helps to hold the fiberglass filaments in place and to protect them from breakage. The resulting composite yarn is more supple and has more strength. That is, a thinner yarn may be constructed having the same strength as previous yarns using two parallel core strands, one fiberglass and one non-fiberglass. In those constructions the fiberglass strand acts as a supporting strand for the second strand which is relied upon for the cut/abrasion resistant quality. As will be understood by one of ordinary skill in the art, the core construction of the present invention offers the same performance in a yarn that has improved manufacturing characteristics. Moreover, the yarn may be manufactured at reduced cost for the same measure of performance.

In its broadest sense the present invention comprises a fiberglass supported core yarn having a substantially untwisted fiberglass strand and a sheath yarn strand wrapped about the fiberglass strand. The sheath strand is wrapped about the fiberglass strand at a rate of at least 8 turns per inch. The term core yarn means the combination of the fiberglass strand and the sheath strand which is intended to be used: 1) alone as the core construction of a composite yarn or 2) as one component of a multiple-component composite yarn core. In the first usage the core yarn of the present invention may be covered with another yarn or yarns. In the second usage, it is believed that the core yarn may be laid parallel to another yarn or yarns, or may be twisted or braided with another yarn or yarns to form a composite yarn core.

The untwisted fiberglass strand and the cover strand mutually benefit each other. The fiberglass component acts as a support for the cut/abrasion resistant cover and the cover permits the brittle fiberglass to be knit on conventional knitting machinery. Properties of the resulting yarn may be varied by the choice of yarn composition, denier and the rate of wrap (turns per inch) of the sheath yarn about the fiberglass strand.

It should be noted that the core construction of the present yarn may be put to use without the use of the cover yarns. However, given the benefits of manufacturing ease and final use options for the finished product, the cover yarns are desirable.

The yarn construction of the present invention permits the finished product to have more of the cut-resistant material in a given length compared to a yarn having a core with two parallel strands. For example, in 12 inches of such a prior art yarn structure, there will be 12 inches of both fiberglass and a cut resistant material such as SPECTRA® fiber in the yarn core. In a 12 inch length of the yarn of the present invention, the fiberglass supports from about a 30% to about 50% longer length of a cut resistant yarn with no penalty in increased bulk because the SPECTRA® fiber is wound around rather than laid alongside the fiberglass core.

Another advantage of the yarn of the present invention is the ability to control yarn properties through the selection of the sheath strand. It has been discovered that the use of the textured nylon creates a stronger yet soft, more breathable yarn. The use of a non-textured flat yarn creates a smoother core surface. It is believed that the sheath strand expands about the single fiberglass strand to create these properties.

The advantages discussed above expand the known range of suitable uses for cut/abrasion resistant fabrics. Possible new uses include fire hoses, motorcycle jackets, seat covers for automobiles, airplanes and buses, protective clothing/padding for skaters, the toe/heel regions of hosiery and outerwear fabrics. The last of these uses is significant as known cut or abrasion resistant fabrics have been used primarily for industrial applications, e.g. meat packing facilities, and not for everyday clothing. Previously these fabrics did not have the suppleness, hand or appearance characteristics suitable for fashion apparel.

Although the present invention has been described with preferred embodiments, it is to be understood that modifications and variations may be utilized without departing from the spirit and scope of this invention, as those skilled in the art would readily understand. Such modifications and variations are considered to be within the purview and scope of the appended claims and their equivalents.

What is claimed is:

1. A composite yarn comprising:

a) a core consisting of i) a substantially untwisted fiberglass strand having a denier of between about 100 and about 1200;

ii) a non-metallic sheath strand having a denier of between about 200 and about 700, the sheath strand being wrapped around the fiberglass strand at the rate of at least 8 turns per inch, and b. at least one cover strand wrapped around the core at a rate of between about 6 and about 12 turns per inch, whereby the sheath strand permits the fiberglass strand to be knitted using conventional knitting equipment.

2. The composite yarn of claim 1 wherein said sheath is from a textured yarn.

3. The composite yarn of claim 1 wherein said sheath strand is formed of fibers or filaments selected from the group consisting of extended chain polyethylene, aramid, nylon, and polyester.

4. The composite yarn of claim 1 wherein said sheath strand has a denier of about 375.

5. The composite yarn of claim 1 further comprising a second non-metallic cover strand wrapped on said yarn, said second cover being wrapped about said at least one cover strand in a direction opposite that of the at least one cover strand, wherein the yarn has a composite denier of from about 1800 to about 5000.

6. The composite yarn of claim 5 wherein said second non-metallic cover is wrapped at a rate of about 7 to 11 turns per inch.

7. The composite yarn of claim 5 wherein said second non-metallic cover is wrapped at a rate of about 8 to about 9 turns per inch.

8. The composite yarn of claim 5 wherein said second non-metallic cover has a denier of between about 400 and about 800.

9. The composite yarn of claim 5, wherein second non-metallic cover has a denier of about 650.

10. The composite yarn of claim 5 wherein said bottom cover strand is formed of fibers or filaments selected from the group consisting of extended chain polyethylene, aramid, nylon, and polyester.

11. A flexible composite, cut and abrasion resistant yarn comprising:

a) a non-metallic composite core consisting of:

i) a first fiberglass strand;

ii) a second fiberglass strand, the second fiberglass stand being substantially parallel to and in untwisted relationship with the first fiberglass strand, wherein the first and second fiberglass strands have a combined denier of between about 200 and about 600;

iii) a sheath strand having a denier of between about 200 to about 600, the sheath strand being wrapped around the first and second fiberglass strands at the rate of at least 8 turns per inch whereby the sheath strand permits the fiberglass strand to be knitted using conventional knitting equipment; and b) a non-metallic covering wrapped on said core, said covering including:

i) a bottom cover strand wrapped about the core in a first direction, the bottom cover having a denier of about 650 an being formed of fibers or filaments of extended chain polyethylene;

ii) a top cover strand wrapped about said bottom cover strand in a second direction opposite to the first direction, the top cover strand having a denier of about 400 and being formed from fibers of filaments of nylon, wherein the yarn has a composite denier of between about 1800 and about 5000.

12. A flexible, composite, cut and abrasion resistant yarn comprising:

a) a non-metallic composite core consisting of:

i) a substantially untwisted single fiberglass strand having a denier of between about 100 and about 1200;

ii) a sheath strand having a denier of between about 200 and about 600, the sheath strand being wrapped around the single fiberglass strand at a rate of at least 8 turns per inch whereby the sheath strand permits the fiberglass strand to be knitted using conventional knitting equipment; and b) a non-metallic covering wrapped on said core, said covering including:

i) a bottom cover strand wrapped about the core in a first direction, the bottom cover having a denier of between about 400 and about 800;

ii) a top cover strand wrapped about said bottom cover strand in a second direction opposite to the first direction, the top cover strand having a denier of between about 400 and about 800, wherein the yarn has a composite denier of between about 1800 and about 5000.

13. The composite yarn of claim 12 wherein said sheath strand is formed from a textured yarn.

14. The composite yarn of claim 12 wherein said sheath strand is formed of fibers or filaments selected from the group consisting of extended chain polyethylene, aramid, nylon, and polyester.

15. The composite yarn of claim 12 wherein said sheath strand has a denier of about 375.

16. The composite yarn of claim 12 wherein said bottom cover is wrapped about said core at a rate of about 7 to 10 turns per inch.

17. The composite yarn of claim 12 wherein said bottom cover strand is wrapped about said core at a rate of about 8 to 9 turns per inch.

18. The composite yarn of claim 12 wherein said bottom cover strand has a denier of between about 400 and about 800.

19. The composite yarn of claim 12 wherein said bottom cover strand has a denier of about 650.

20. The composite yarn of claim 12 wherein said bottom cover strand is formed of fibers or filaments selected from the group consisting of extended chain polyethylene, aramid, nylon, and polyester.

21. The composite yarn of claim 12 wherein said top cover is wrapped about said core and said bottom cover at a rate of about 8 to about 11 turns per inch.

22. The composite yarn of claim 12 wherein said top cover is wrapped about said core and said bottom cover at a rate of about 9 to about 10 turns per inch.

23. The composite yarn of claim 12 wherein said top cover strand has a denier of between about 400 and about 800.

24. The composite yarn of claim 12 wherein said top cover strand has a denier of about 500.

25. The composite yarn of claim 12 wherein said top cover strand is formed of fibers or filaments selected from the group consisting of extended chain polyethylene, aramid, nylon, and polyester.

26. A flexible, cut and abrasion resistant composite yarn comprising:

a) a non-metallic composite core consisting of:

i) a single substantially untwisted fiberglass strand having a denier of between about 100 and about 1200;

ii) a sheath strand, said strand formed of extended chain polyethylene and having a denier of between about 375 and about 650, the sheath strand being wrapped around the fiberglass strand at the rate of 12 to 14 turns per inch whereby the sheath strand permits the fiberglass strand to be knitted using conventional knitting equipment; and b) a non-metallic covering wrapped on said core, said covering including:

i) a bottom cover strand formed of extended chain polyethylene wrapped about said core in a direction opposite that of the sheath strand, the bottom cover strand having a denier of about 650; and ii) a top cover strand formed of polyester and wrapped about said core and said bottom cover strand in a direction opposite that of the bottom cover, the top cover strand having a denier of between about 500 and about 1000, wherein the yarn has a composite denier of between about 1800 and about 5000.

27. A flexible composite, cut and abrasion resistant yarn comprising:

a core consisting of a) a first fiberglass strand;

b) a second fiberglass strand, the second fiberglass strand being substantially parallel to and in untwisted relationship with the first fiberglass strand, wherein the first and second fiberglass strands have a combined denier of about between about 200 and about 600;

c) a sheath strand having a denier of between about 200 to 600, the sheath strand being wrapped around the first and second fiberglass strands at the rate of at least 8 turns per inch, and d) at least one cover strand wrapped around the core at a rate of between about 6 and about 12 turns per inch, whereby the sheath strand permits the fiberglass strands to be knitted using conventional knitting equipment.

* * * * *